US006352419B1

(12) United States Patent
Thompson et al.

(10) Patent No.: US 6,352,419 B1
(45) Date of Patent: Mar. 5, 2002

(54) INTERNAL GEAR PUMP HAVING A SHAFT SEAL

(75) Inventors: Nicholas Vernon Thompson; Jason Kyle Reuther; James Michael Mayer, all of Cedar Falls, IA (US)

(73) Assignee: Viking Pump, Cedar Falls, IA (US)

( * ) Notice: Subject to any disclaimer, the term of this patent is extended or adjusted under 35 U.S.C. 154(b) by 0 days.

(21) Appl. No.: 09/675,334

(22) Filed: Sep. 28, 2000

Related U.S. Application Data

(62) Division of application No. 09/248,810, filed on Feb. 11, 1999, now Pat. No. 6,149,415.

(51) Int. Cl.[7] ..... F04C 15/00
(52) U.S. Cl. ..... 418/104
(58) Field of Search ..... 418/104

(56) References Cited

U.S. PATENT DOCUMENTS

| | | | | |
|---|---|---|---|---|
| 1,896,033 A | | 1/1933 | Sperry | 418/170 |
| 3,276,387 A | | 10/1966 | Bottoms | 418/170 |
| 4,435,136 A | * | 3/1984 | Terauchi et al. | 418/104 |
| 5,372,115 A | * | 12/1994 | Straub et al. | 418/152 |
| 5,531,578 A | * | 7/1996 | Takemoto et al. | 418/104 |
| 5,785,510 A | * | 7/1998 | Altieri, Jr. et al. | 418/104 |

FOREIGN PATENT DOCUMENTS

| | | | | |
|---|---|---|---|---|
| DE | 3410-015 A | | 9/1985 | |
| JP | 63-297788 | | 12/1988 | |
| JP | -5-87077 | * | 4/1993 | 418/104 |

* cited by examiner

*Primary Examiner*—John J. Vrablik
(74) *Attorney, Agent, or Firm*—Marshall, Gerstein, & Borun

(57) ABSTRACT

An improved internal gear pump design is provided whereby the head plate includes a groove located vertically above the crescent for providing improved axial feed to the roots or innermost spaces between the idler teeth. The design of the pump also includes a stepped shaft design whereby the radius of the shaft immediately adjacent to the rotor is greater than an adjacent outboard section of the shaft. As a result, a chamber for housing the seal assembly is defined as the space between the stepped shaft portion, the annular seal plate, the outboard section of the shaft that has a lesser or reduced diameter, and the casing. The casing may also include a recess for providing sufficient space for the seal assembly. The larger section of the shaft is accommodated in a bushing mounted to the inside surface of the casing. The inside diameter of the bushing is large enough to accommodate the larger stepped portion of the shaft as well as the outside diameter of the seal assembly. As a result, the seal assembly may be pre-mounted onto its respective section of the drive shaft prior to the insertion of the drive shaft through the pump chamber.

2 Claims, 4 Drawing Sheets

INTERNAL GEAR PUMP HAVING A SHAFT SEAL

This application is a division of Ser. No. 09/248,810 filed Feb. 11, 1999, now U.S. Pat. No. 6,149,415.

FIELD OF THE INVENTION

The present invention relates generally to internal gear pumps and, more specifically, to an improved head plate or cover plate for internal gear pumps, an improved shaft and seal assembly design as well as improved methods of assembling internal gear pumps.

BACKGROUND OF THE INVENTION

Internal gear pumps are known and have long been used for the pumping of thin liquids at relatively high speeds. The typical internal gear pump design includes a rotor mounted to a drive shaft. The rotor includes a plurality of circumferentially disposed and spaced apart rotor teeth that extend axially toward an open end of the pump casing. The open end of the pump casing is typically covered by a head plate or cover plate which, in turn, is connected to an idler. The idler is eccentrically mounted to the head plate with respect to the rotor teeth. The idler also includes a plurality of spaced apart idler teeth disposed between alternating idler roots. The idler teeth are tapered as they extend radially outward and each idler tooth is received between two adjacent rotor teeth. The rotor teeth, in contrast, are tapered as they extend radially inward. A crescent or sealing wall is disposed below the idler and within the rotor teeth. The crescent provides a seal to prevent the loss of fluid disposed between the idler teeth as the idler teeth rotate. The rotor teeth extend below the crescent before rotating around to receive an idler tooth between two adjacent rotor teeth.

The input and output ports for internal gear pumps are disposed on opposing sides of the rotor. The fluid being pumped is primarily carried from the input port to the output port to the space or roots disposed between adjacent idler teeth. This space may be loaded in two ways: radially and axially. The space is loaded radially when fluid passes between adjacent rotor teeth before being received in a root disposed between adjacent idler teeth. Further, there is typically a gap between the distal ends of the rotor teeth and the head plate or casing cover which permits migration of fluid from the inlet port to an area disposed between the head plate and the idler. After migrating into this area, the fluid can be sucked into the area or root disposed between adjacent idler teeth during rotation of the idler and rotor.

However, it has been found that it is very difficult to ensure a complete loading of the innermost area between the idler teeth or the root disposed between adjacent idler teeth. The failure to provide a complete loading of this area results in an inefficiency of the pump. Therefore, there is a need for a way to improve the loading of the idler roots or the loading of internal gear pumps as a means for improving efficiencies.

Another problem commonly associated with internal gear pumps is the difficulty in assembling these pumps. Specifically, a seal is needed between the rotor and the bearing assembly or the outboard end of the drive shaft. Because the rotor is typically fixedly connected to the drive shaft, the drive shaft must be passed through the pump chamber and casing during an initial installation step. Then, from an opposing end of the casing, a seal assembly must be inserted over the outboard end of the drive shaft and pushed into place in the casing between the motor housing and the pump chamber. Because the shaft is already in place, the seal assembly must be installed blindly or without being able to view the seal assembly or the section of shaft upon which it is installed during installation thereof. As a result, the installation of the seal assembly is time consuming and the seal assembly can often be damaged during installation. Further, the seal assemblies are susceptible to being installed incorrectly, which is not detected until the pump is tested.

Therefore, there is a need for an improved internal gear pump design which facilitates the assembly of the pump and, more specifically, the installation of the seal assemblies over the drive shafts.

SUMMARY OF THE INVENTION

The present invention satisfies the aforenoted needs by providing an improved internal gear pump that includes an improved head plate design which features a groove disposed on the inside surface of the head plate for providing an improved axial feed to the idler root. The gear pump of the present invention also includes a step shaft design whereby a first segment of the drive shaft that passes through the seal assembly has a first diameter and is disposed immediately adjacent to a second step segment having a second larger diameter. The second step segment is disposed between the first segment and the rotor and, preferably, is disposed immediately adjacent to the rotor. The section of the casing through which the first and second segments of the drive shaft pass includes two recessed sections. A first recess section through which the first segment passes defines a chamber for housing the seal assembly. A second recessed section through which the second segment of the drive shaft passes includes a slightly wider recess for accommodating a bushing. The second step segment of the drive shaft rotates within this bushing.

Therefore, a seal assembly chamber is defined at one end by an annular seal plate, at an opposing end by the second segment of the drive shaft and the diameter of the seal chamber is defined by the first recessed section of the casing. Further, the bushing is sized so that the seal assembly can be mounted onto the first segment of the drive shaft and passed through the bushing thereby eliminating any blind installation of the seal assembly after the drive shaft is in place.

In an embodiment, the present invention provides an internal gear pump that comprises a casing comprising a pump chamber, an open end and an inlet. The pump further comprises a shaft connected to a rotor. The shaft passes through the casing and the rotor is disposed in the pump chamber. The rotor comprises a plurality of circumferentially disposed and spaced apart rotor teeth that extend axially towards the open end of the casing. The open end of the casing is connected to a head plate. The head plate comprises an inside surface that faces the rotor. The inside surface of the head plate comprises a crescent disposed vertically above at least a portion of the rotor teeth. The inside surface of the head plate further comprises an idler feed groove disposed vertically above the crescent. The inside surface of the head plate is also connected to an idler. The idler comprises a plurality of radially outwardly extending idler teeth disposed between a plurality of roots. The crescent is disposed between a portion of the rotor teeth and a portion of the idler teeth. Each of the idler teeth are received between two of the rotor teeth. The idler feed groove provides communication between the inlet and the idler roots.

In an embodiment, each idler root comprises a radially inwardly disposed surface. The idler feed groove provides communication between the inlet and the radially inwardly disposed surfaces of the idler roots.

In an embodiment, the idler is connected to the inside surface of the head plate with an idler pin. The idler feed groove is disposed between the idler pin and the crescent.

In an embodiment, the present invention provides an improved internal gear pump that includes a rotor and an idler disposed inside a pump chamber defined by a casing having an open end covered by a head plate. The casing has an inlet. The idler includes a plurality of teeth alternatingly disposed between a plurality of roots. The improvement comprises an idler feed groove disposed in the head plate which provides enhanced fluid communication between the inlet and the roots of the idler.

In an embodiment, the head plate further includes a crescent disposed vertically below the idler and wherein the idler feed groove is disposed vertically above the crescent.

In an embodiment, the present invention provides a pump that includes a casing that defines a pump chamber. A shaft passes through the casing and is connected to a rotor disposed in the pump chamber. The shaft comprises a first segment passing through an annular seal plate and a second segment connected to the rotor. The second segment is disposed between the first segment and the rotor. The first segment has a first diameter; the second segment has a second diameter; the second diameter is greater than the first diameter. The second segment of the shaft passes through a stationary bushing mounted onto an inside surface of the casing. The casing, seal plate and second segment of the shaft define an annular seal cavity disposed between the seal plate and the second segment of the shaft. The seal cavity accommodates a seal assembly. The seal assembly has an outer diameter and an inner diameter. The bushing has an inner diameter. The outer diameter of the seal assembly is less than the inner diameter of the bushing and less than the second diameter of the second segment of the shaft.

In an embodiment, the inside surface of the casing comprises a recess for accommodating the bushing.

In an embodiment, the stationary bushing is a carbon graphite bushing.

In an embodiment, the second segment of the shaft is disposed immediately adjacent to the rotor.

In an embodiment, the present invention provides a method of manufacturing a pump that comprises the steps of providing a shaft comprising an inboard end and an outboard end. The inboard end of the shaft is connected to a rotor. The shaft further comprises a first segment disposed between the outboard end and the rotor. The first segment has a first diameter. The shaft further comprises a second segment disposed between the first segment and the rotor. The second segment of the shaft has a second diameter. The second diameter is greater than the first diameter. The method further includes the step of providing a casing comprising a pump chamber for accommodating the rotor, an open end and an outboard section for accommodating the shaft. The outboard section of the casing comprises a first recessed area defining a seal cavity. The outboard section of the casing further comprises a second recessed area for accommodating a stationary annular bushing. The bushing comprises an inside diameter that is larger than the second diameter of the second segment of the shaft. The method further includes the step of providing a seal assembly for mounting over the first segment of the shaft and within the seal cavity. The seal assembly has an outside diameter that is less than the inside diameter of the bushing and an inside diameter that is smaller than the second diameter of the second segment of the shaft. The method further includes the step of mounting the seal assembly over the first segment of the shaft so that the seal assembly abuts the second segment of the shaft. The method further includes the step of passing the outboard end of the shaft, the seal assembly and the first and second segments of the shaft through the pump chamber and through the bushing until the rotor is disposed in the pump chamber, the second segment of the shaft is disposed within the bushing and the seal assembly is disposed within the seal cavity.

In an embodiment, the method of the present invention further comprises the following steps prior to the passing step: providing an annular seal plate having an inner diameter that is greater than the first diameter of the first segment of the shaft, and attaching the seal plate to the casing so the first recessed area is disposed between the seal plate and the second recessed area.

In an embodiment, the method of the present invention further comprises the following steps after the passing step: providing an annular seal plate having an inner diameter that is greater than the first diameter of the first segment of the shaft, and attaching the seal plate to the casing so that the seal assembly is trapped between the seal plate and the second segment of the shaft.

It is therefore an advantage of the present invention to provide an improved internal gear pump that provides improved axial loading of the idler.

Yet another advantage of the present invention is that it provides an internal gear pump with an improved head plate design that facilitates the axial loading of the idler.

Still another advantage of the present invention is that it provides an internal gear pump design with improved efficiencies.

Another advantage of the present invention is that it provides an improved internal gear pump that is easier and faster to assemble.

Yet another advantage of the present invention is that it provides an internal gear pump which provides easier and faster access to the seal assembly.

Other objects and advantages of the present invention will be apparent from the following detailed description and appended claims, and upon reference to the accompanying drawings.

BRIEF DESCRIPTION OF THE DRAWINGS

The present invention is illustrated more or less diagrammatically in the following drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
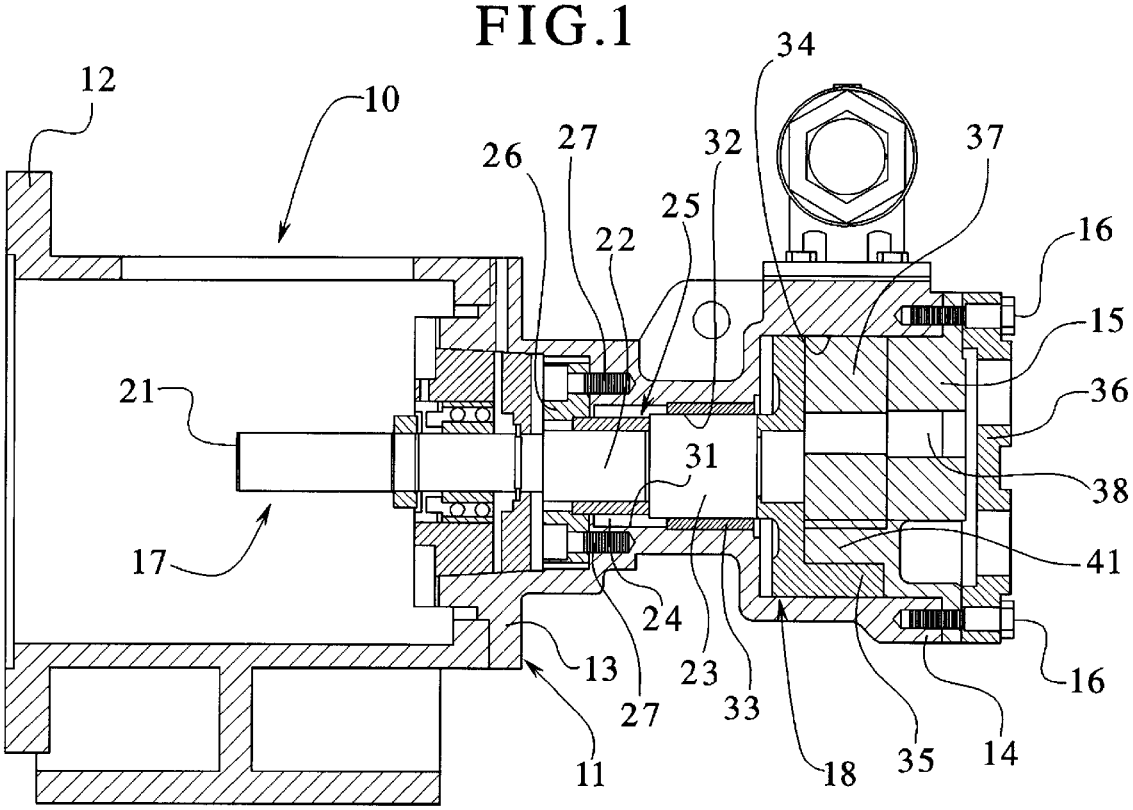
FIG. 1 is a sectional view of an internal gear pump made in accordance with the present invention.
Figure 3:
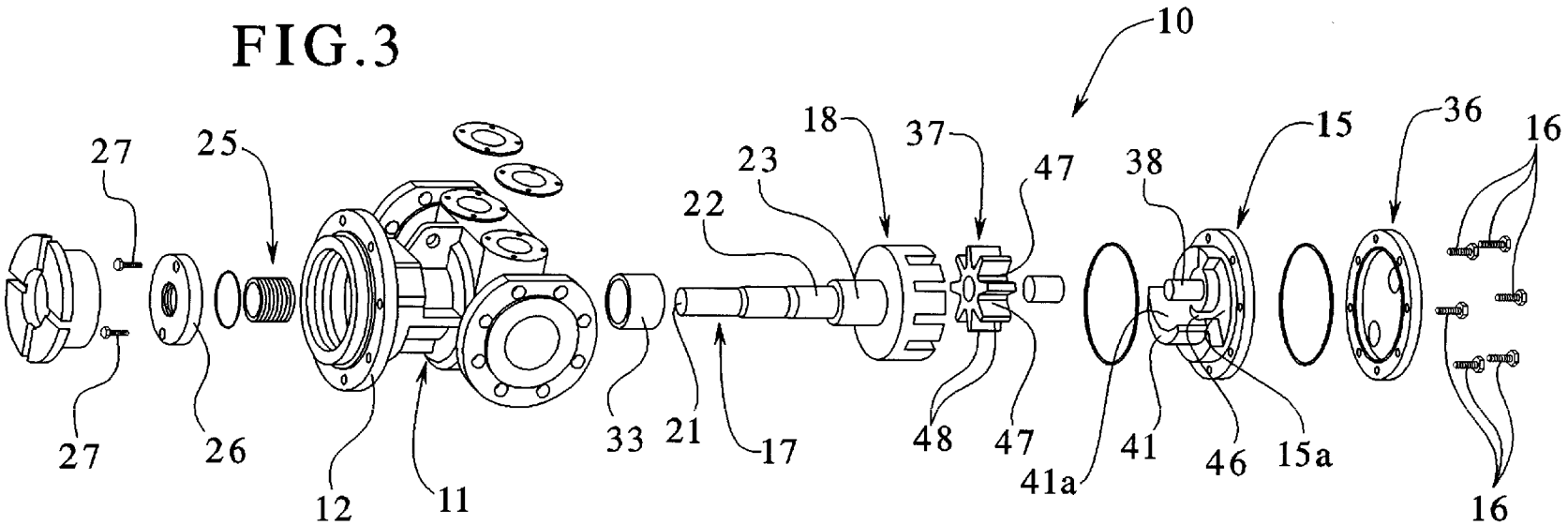
FIG. 3 is an exploded view of the internal gear pump shown in FIG. 1.

Turning first to FIG. 1, a pump 10 is illustrated which includes a casing 11 connected to a bracket 12. The casing 11 further includes an inboard end 13 and an open end 14 which is connected to a head plate 15 by the bolts shown at 16. A shaft 17 is connected to a rotor 18. The shaft includes an outboard end 21 and stepped segments 22, 23. It will be noticed that the segment 23 has a greater diameter than the segment 22. The purpose of the stepped arrangement shown between segments 22 and 23 is to define a chamber 24 for accommodating a seal assembly 25, 25*a* or 25*b* as discussed in greater detail below with respect to FIGS. 3, 3A and 3B. Returning to FIG. 1, the chamber 24 is disposed between the segment 23 of the shaft 17 and the annular seal plate 26. The seal plate 26 is attached to the casing 11 with the bolts shown at 27. The casing 11 further includes recesses shown at 31 and 32. The recess 31 defines the outer periphery of the seal assembly chamber 24. The recess 32 accommodates a bushing 33. The bushing 33 accommodates the larger segment 23 of the shaft 17. Further, it will be noted that the inside diameter of the bushing 33 is sufficiently large enough to accommodate an outside diameter of the seal assemblies 25, 25*a* and 25*b*. Accordingly, the seal assemblies 25, 25*a* or 25*b* can be mounted onto the segment 22 of the shaft 17 prior to the insertion of the outboard end 21 of the shaft 17 through the pump chamber 34. In this manner, the seal assemblies 25, 25*a* and 25*b* can be pre-mounted to the shaft 17 and need not be mounted onto the shaft 17 after the shaft 17 and rotor 18 are in place inside the casing 11.

Figure 2:
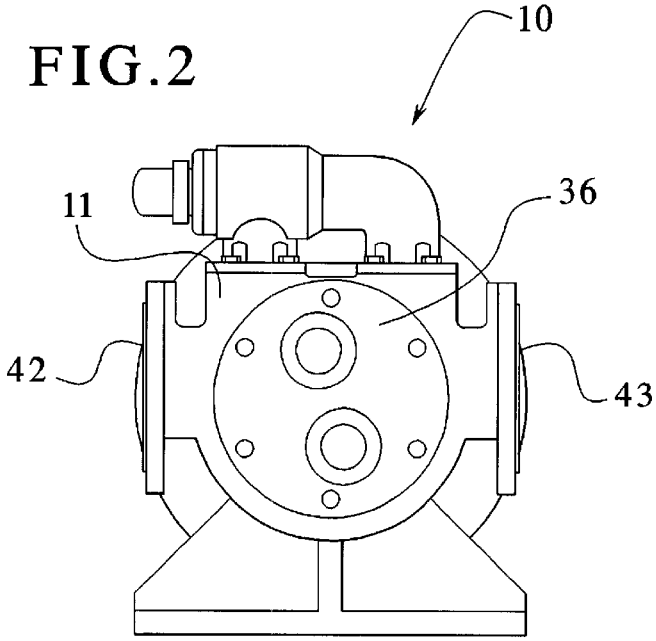
FIG. 2 is an end view of the internal gear pump shown in FIG. 1.

Still referring to FIG. 1, it will be noted that the rotor 18 includes a plurality of teeth 35 that extend axially toward the opened end 14 of the casing or towards the head plate 15. The head plate 15 can also include an outer jacket plate 36. The head plate 15 is attached to the idler 37 by way of an idler pin 38. The idler 37 is mounted eccentrically within the teeth 35 of the rotor 18. The head plate 15 also includes a crescent 41 which provides a seal below the idler 37 as it rotates towards the outlet 43 (see FIG. 2). The inlet is shown at 42.

Figure 4A:
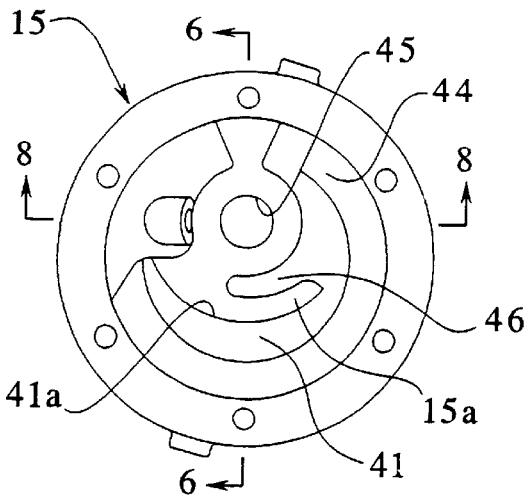
FIG. 4A is a plan view of the inside surface of the head plate of the internal gear pump shown in FIG. 1.
Figure 5:
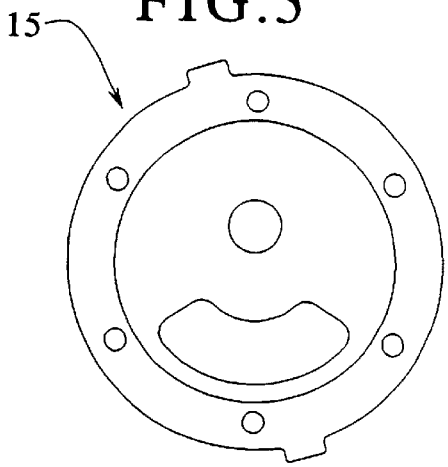
FIG. 5 is a plan view of the outside surface of the head plate shown in FIG. 4A.
Figure 6:
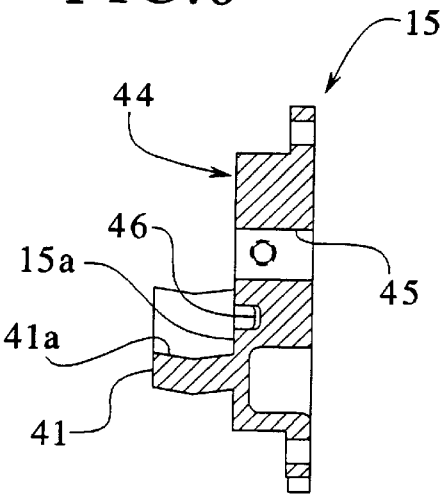
FIG. 6 is a sectional view taken substantially along line 6—6 of FIG. 4A.
Figure 7:
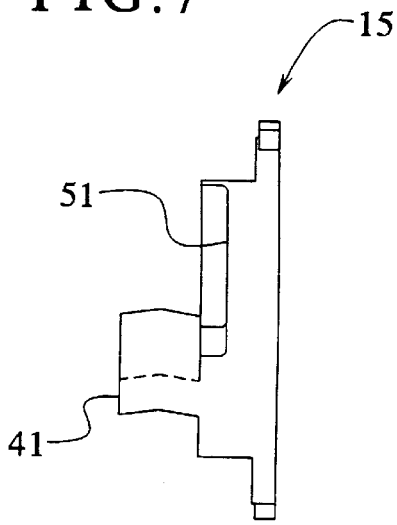
FIG. 7 is a side view of the head plate shown in FIG. 4A.
Figure 8:
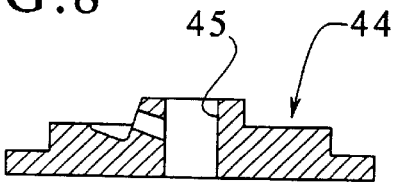
FIG. 8 is a sectional view taken substantially along line 8—8 of FIG. 4A.
Figure 4B:
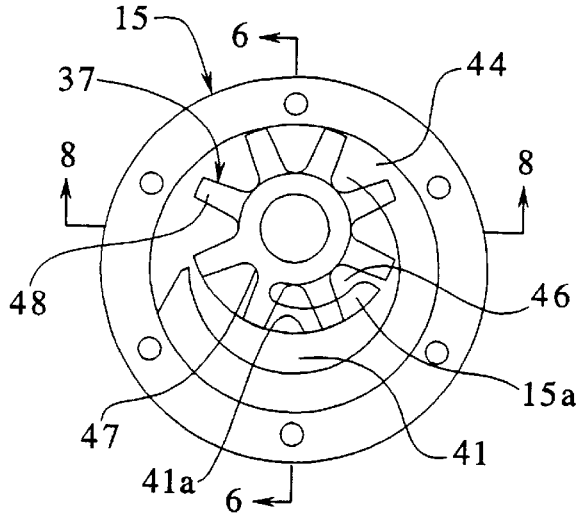
FIG. 4B is a plan view of the inside surface of the head plate illustrating the positioning of the idler thereon.
Figure 9:
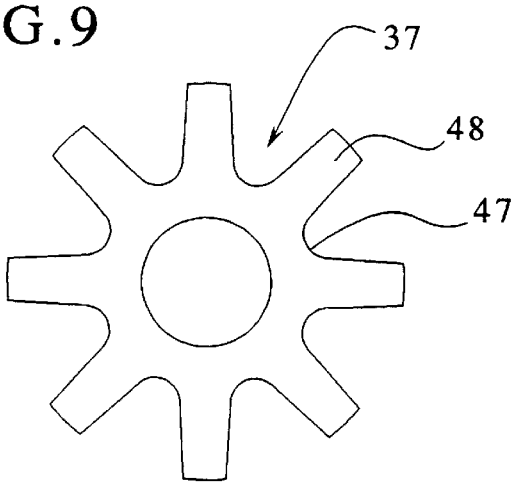
FIG. 9 is a plan view of the idler shown in FIG. 3.
Figure 10:
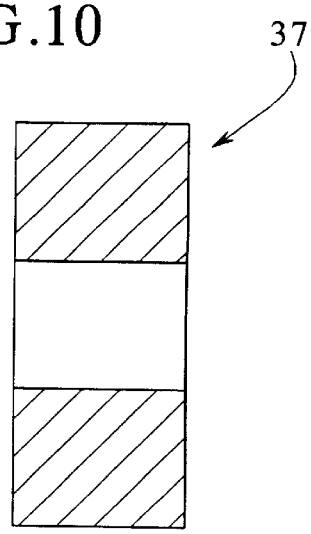
FIG. 10 is a sectional view of the idler shown in FIG. 9.
Figure 11:
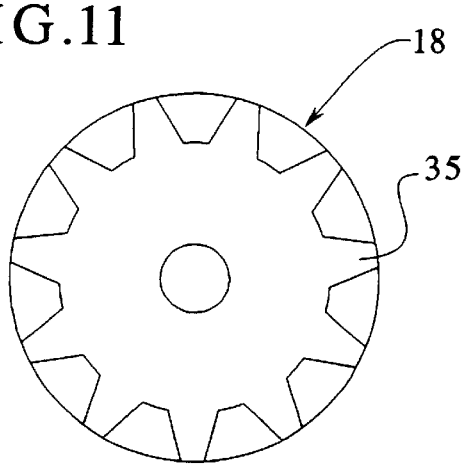
FIG. 11 is a front plan view of the rotor shown in FIG. 3.
Figure 12:
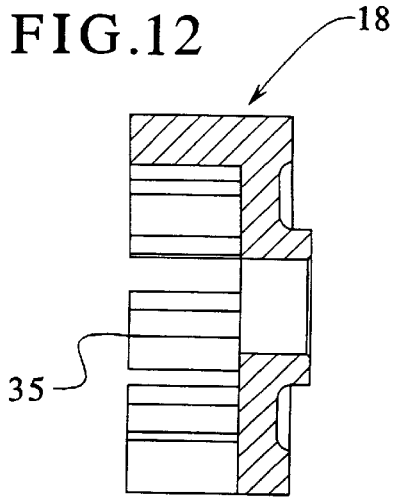
FIG. 12 is a sectional view of the idler shown in FIG. 11.

Turning to FIGS. 4A and 4B, an inside surface 44 of the head plate 15 is illustrated. An aperture 45 is provided for the idler pin 38 (see FIG. 1). Between the aperture 45 and the crescent 41 is a slot 46 (see also FIG. 6). The slot or groove 46 provides fluid communication from the inlet 42 to the roots 47 of the idler 37 (see FIGS. 9 and 10). As discussed above, the roots 47 of the idler 37 are disposed between the radially outwardly extending idler teeth shown at 48. The feed groove 46 facilitates the axial loading of the roots 47 and improves the efficiency of the pump 10. Turning to FIG. 7, an additional feature of the head plate 15 is the recess 51 which also contributes to the axial loading of the idler 37. However, it has been found that the groove 46 is especially effective in terms of the loading of the roots 47 of the idler 37 and, particularly, the inside surfaces of the idler 37 defined by the roots 47.

Returning to FIG. 3, it will be noted that the outside diameter of the shaft segment 23 as well as the outside diameter of the seal assembly 25 (and 25*a*, 25*b*) are small enough to pass through the bushing 33. Accordingly, the seal assembly 25 (or 25*a*, 25*b*) may be mounted onto the shaft segment 22 prior to the insertion of the outboard end 21 of the shaft 17 through the opened end 14 of the casing 11. This is a dramatic improvement over prior art pump designs because, as discussed above, the seal assembly 25 would ordinarily need to be inserted over the shaft 17 after the shaft 17 and rotor 18 are already in place inside the casing 11. This prior art procedure would require the seal assembly 25 to be inserted through the outboard end 13 of the casing 11. Further, the installer of the seal assembly 25 is, of course, unable to see the appropriate segment of the shaft 17 on which the assembly 25 is being installed. Thus, in prior art designs, the seal assembly 25 would need to be installed on a blind basis which is time consuming and prone to error.

Figure 3B:
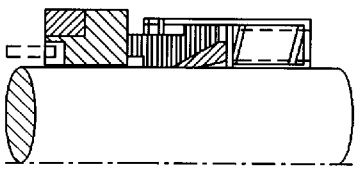
FIG. 3B is another embodiment of a seal assembly that can be employed in the internal gear pump shown in FIG. 1.
Figure 3A:
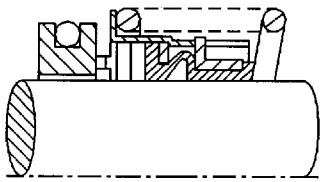
FIG. 3A is a partial sectional view of one embodiment of the seal assembly that can be employed in the internal gear pump shown in FIG. 1.

Turning to FIGS. 3A and 3B, suitable seal assemblies 25*a* and 25*b* are illustrated. These assemblies 25*a* and 25*b* are known in the art and are available from the Crane Manufacturing Company (Type 2 and Type 9 respectively).

From the above description, it is apparent that the objects and advantages of the present invention have been achieved. While only certain embodiments have been set forth and described, other alternative embodiments and various modifications will be apparent from the above description to those skilled in the art. These and other alternatives are considered equivalents and within the spirit and scope of the present invention.

What is claimed is:

1. A pump comprising:

a casing comprising an inboard end comprising an annular seal section, the annular seal section connected to an outboard end of the casing that comprises a pump chamber, the annular seal section accommodating a shaft and the pump chamber accommodating a rotor, the shaft connected to the rotor, the annular seal section comprising a first recessed area and a second recessed area, the second recessed area being disposed between the first recessed area and the pump chamber and extending into the pump chamber, the first recessed area extending into the second recessed area, the first recessed area having a uniform outer diameter, the second recessed area having a uniform outer diameter, the uniform outer diameter of the second recessed area being greater than the uniform outer diameter of the first recessed area, the pump chamber also having a diameter that is greater than the uniform outer diameter of the second recessed area, the shaft comprising a first segment that extends into the first recessed area and a second segment that extends into the second recessed area, the second segment being disposed between and connected to the rotor and the first segment, the first segment having a uniform outer diameter and the second segment having a uniform outer diameter that is greater than the uniform outer diameter of the first segment, the rotor having an outer diameter that is greater than the uniform outer diameter of the second segment, the second recessed area accommodating a stationary bushing, the second segment of the shaft being at least partially accommodated in the stationary bushing, the first segment of the shaft being at least partially accommodated in an annular seal assembly, the annular seal assembly having a maximum outer diameter that is less than the uniform outer diameter of the first recessed area.

2. The pump of claim 1 wherein the stationary bushing is a carbon graphite bushing.

* * * * *